US008286558B2

(12) United States Patent
Marx

(10) Patent No.: US 8,286,558 B2
(45) Date of Patent: Oct. 16, 2012

(54) THERMOSET POLYMER GUIDE BAND FOR PROJECTILES

(75) Inventor: PJ Marx, Sarasota, FL (US)

(73) Assignee: Liberty Ammunition, Inc., Clearwater, FL (US)

( * ) Notice: Subject to any disclaimer, the term of this patent is extended or adjusted under 35 U.S.C. 154(b) by 94 days.

(21) Appl. No.: 12/784,842

(22) Filed: May 21, 2010

(65) Prior Publication Data

US 2011/0259232 A1 Oct. 27, 2011

Related U.S. Application Data

(63) Continuation-in-part of application No. 12/784,647, filed on May 21, 2010.

(60) Provisional application No. 61/326,839, filed on Apr. 22, 2010.

(51) Int. Cl.
*F42B 14/02* (2006.01)
*F42B 14/04* (2006.01)

(52) U.S. Cl. ..... 102/527

(58) Field of Classification Search ..... 102/517, 102/524, 527, 529

See application file for complete search history.

(56) References Cited

U.S. PATENT DOCUMENTS 2,360,473 A * 10/1944 Calkins ..... 102/511
2,996,010 A 8/1961 Frantik
2,998,779 A 9/1961 MacRoberts
3,059,578 A 10/1962 Hegge et al.
3,097,169 A 7/1963 Hall
3,861,311 A 1/1975 Bilsbury
4,446,795 A 5/1984 Price et al.
4,664,034 A 5/1987 Christian
4,833,995 A 5/1989 Gotz et al.
4,899,661 A * 2/1990 Kaelin ..... 102/495

(Continued)

FOREIGN PATENT DOCUMENTS

WO 0244645 A1 6/2002

(Continued)

OTHER PUBLICATIONS

Telmo et al, Discarding Rotating Band for Projectile, United States Statutory Invention Registration, Jul. 3, 1990, Reg. No. H794.

*Primary Examiner* — Bret Hayes

(74) *Attorney, Agent, or Firm* — Ronald E. Smith; Anton J. Hopen; Smith & Hopen, P.A.

(57) ABSTRACT

A projectile includes a leading end formed by a tip having an ogive configuration, a trailing end formed by a frusto-conical base, and a cylindrical mid-section interconnecting the tip and the base. A first annular shoulder is formed where the tip meets the cylindrical mid-section and a second annular shoulder is formed where the mid-section meets the base. A metallic band abuts the second annular shoulder and a third annular shoulder is formed where the metallic band meets the cylindrical mid-section. A trailing end of a thermoset polymer guide band abuts the third annular shoulder and a leading end abuts the first annular shoulder. The thermoset polymer guide band conforms to the shape and size of the cylindrical mid-section. The thermoset polymer guide band may be impregnated with barrel treatment chemicals so that the barrel is cleaned and lubricated when the projectile is fired.

4 Claims, 3 Drawing Sheets

U.S. PATENT DOCUMENTS

| | | | | |
|---|---|---|---|---|
| 5,081,931 | A | 1/1992 | Frye et al. | |
| 5,682,011 | A * | 10/1997 | Sabranski et al. | 102/527 |
| 5,979,332 | A | 11/1999 | Hammer et al. | |
| 6,237,497 | B1 | 5/2001 | Altenau et al. | |
| 6,295,934 | B1 * | 10/2001 | Tepera et al. | 102/525 |
| 6,431,076 | B1 * | 8/2002 | O'Dwyer | 102/525 |
| 6,439,125 | B1 * | 8/2002 | Carter | 102/507 |
| 7,900,561 | B2 * | 3/2011 | Marx | 102/526 |
| 2004/0020399 | A1 * | 2/2004 | Thiesen et al. | 102/527 |
| 2006/0027128 | A1 | 2/2006 | Hober | |
| 2007/0089629 | A1 * | 4/2007 | Marx | 102/524 |
| 2009/0145323 | A1 * | 6/2009 | Gustavsson et al. | 102/524 |
| 2010/0218696 | A1 * | 9/2010 | Marx | 102/517 |
| 2011/0155014 | A1 * | 6/2011 | Marx | 102/517 |
| 2011/0155016 | A1 * | 6/2011 | Marx | 102/524 |

FOREIGN PATENT DOCUMENTS

| | | | |
|---|---|---|---|
| WO | 2009029299 | A1 | 3/2009 |

* cited by examiner

THERMOSET POLYMER GUIDE BAND FOR PROJECTILES

CROSS-REFERENCE TO RELATED APPLICATIONS

This application claims priority to U.S. Provisional Patent Application No. 61/326,839, entitled "Thermoset Polymer Guide Band for Projectiles" filed by the same inventor on Apr. 22, 2010. That patent application is incorporated by reference into this disclosure. This application is also continuation-in-part of and claims priority to U.S. patent application Ser. No. 12/784,647, entitled "Multi-Component Projectile Rotational Interlock" filed by the same inventor on May 21, 2010. That patent application is incorporated by reference into this disclosure.

BACKGROUND OF THE INVENTION

1. Field of the Invention

This invention relates, generally, to the art of projectiles. More particularly, it relates to a projectile that when fired helps maintain the barrel of a high-performance rifle.

2. Description of the Prior Art

High performance weapons such as sniper rifles having high firing rates are subjected to more barrel wear, engraving forces, pressure and fouling than lower performance weapons.

All of these effects reduce the velocity of projectiles fired from such weapons. The effects also cause increased downtime for rifle cleaning, lubrication, and other maintenance procedures.

Thus there is a need for a projectile that reduces rifle downtime and increases projectile velocity by reducing barrel wear, engraving forces, pressure in the barrel, and fouling of the barrel.

However, in view of the art considered as a whole at the time the present invention was made, it was not obvious to those of ordinary skill in the art that such a projectile was needed nor was it obvious how such a projectile could be provided.

SUMMARY OF THE INVENTION

The long-standing but heretofore unfulfilled need for a projectile that provides maintenance for a high performance rifle or similar weapon is now met by a new, useful, and non-obvious invention.

The novel projectile includes a leading end formed by a tip having an ogive configuration, a trailing end formed by frusto-conical base, and a cylindrical mid-section interconnecting the tip and the frusto-conical base to one another. The diameter of the cylindrical mid-section is less than the diameter of the tip at its trailing end and less than the diameter of the frusto-conical base at its leading end. Accordingly, a first annular shoulder is formed where a trailing end of the tip meets a leading end of the cylindrical mid-section and a second annular shoulder is formed where a trailing end of the mid-section meets a leading end of the frusto-conical base.

A metallic band has a trailing end disposed in abutting relation to the second annular shoulder. A third annular shoulder is formed where a leading end of the metallic band meets the cylindrical mid-section.

A thermoset polymer guide band has a trailing end disposed in abutting relation to the third annular shoulder and a leading end disposed in abutting relation to the first annular shoulder. The thermoset polymer guide band conforms to the shape and size of the cylindrical mid-section.

The thermoset polymer guide band is impregnated with barrel treatment chemicals so that the barrel is cleaned, lubricated, and otherwise conditioned when the projectile is fired.

An important object of the invention is to reduce downtime of high performance rifles by reducing the time required to perform routine maintenance of such rifles.

A more specific object is to accomplish the foregoing object by providing a barrel cleaning, lubricating, and conditioning projectile that can be fired in accordance with a maintenance schedule.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the nature and objects of the invention, reference should be made to the following detailed disclosure, taken in connection with the accompanying drawings, in which.

DETAILED DESCRIPTION OF THE PREFERRED EMBODIMENT

Figure 1:
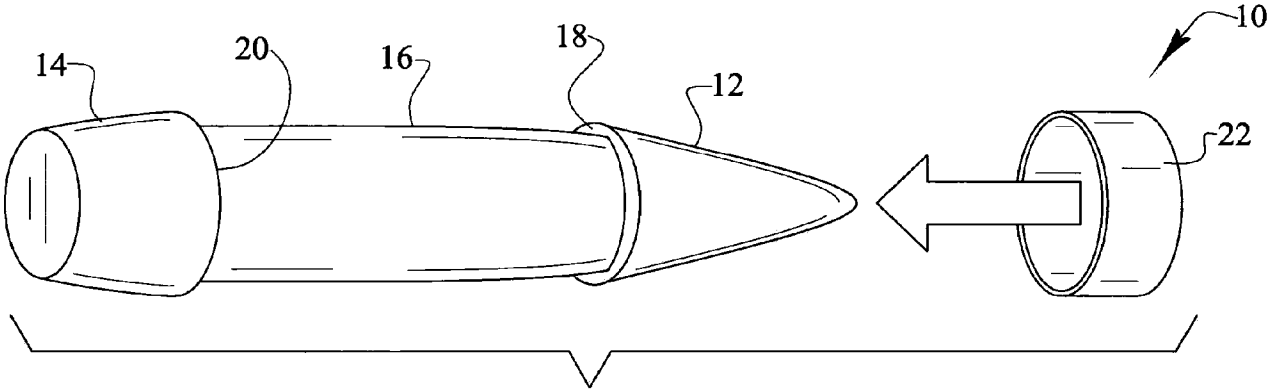
FIG. 1 is an exploded perspective view of the novel projectile.

FIG. 1 depicts an illustrative embodiment of novel projectile which is denoted as a whole by the reference numeral 10.

Projectile 10 is used from time-to-time in accordance with a predetermined maintenance schedule to substantially maintain a rifle barrel in a clean and lubricated operating condition.

Projectile 10 includes a leading end formed by tip 12 of ogive configuration, a trailing end formed by frusto-conical base 14, and a cylindrical mid-section 16 that interconnects said tip and base to one another.

First annular shoulder 18 is formed where the trailing end of tip 12 meets the leading end of mid-section 16. Second annular shoulder 20 is formed where the trailing end of mid-section 16 meets the leading end of base 14.

Metallic band 22 is preferably made of copper although other materials are within the scope of this invention. It has an internal diameter greater than an external diameter of tip 12 so that it can encircle said tip when the projectile is manufactured and abuttingly engage second annular shoulder 20 as depicted in FIG. 2.

Figure 2:
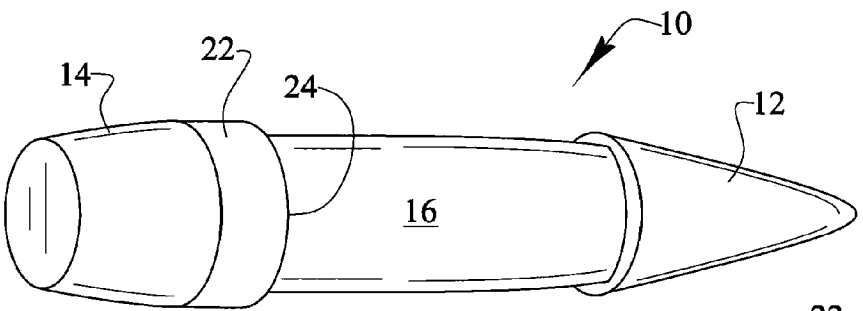
FIG. 2 is a perspective view of the novel projectile when partially assembled.

Third annular shoulder 24 is created when metallic band 22 abuts said second annular shoulder 20 as also depicted in FIG. 2.

Figure 3:
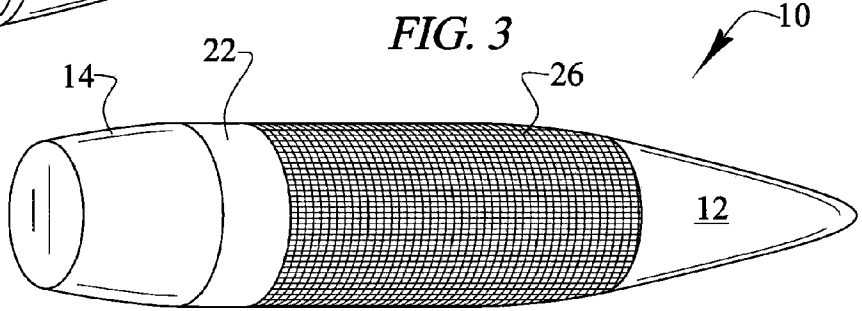
FIG. 3 is a perspective view thereof when fully assembled.
Figure 4:
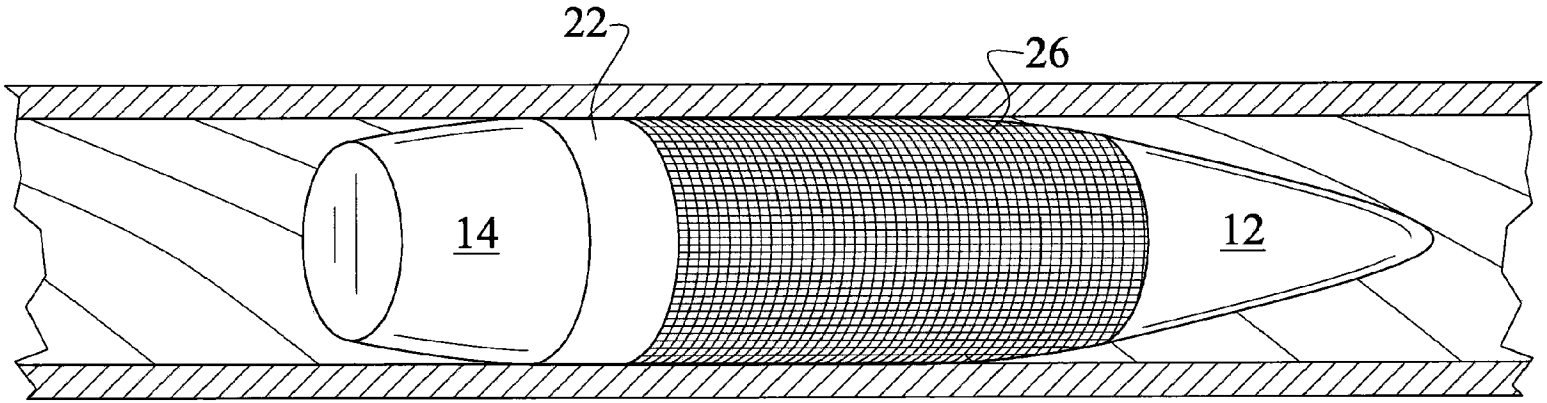
FIG. 4 is a cut-away view of a rifle barrel depicting the fully assembled embodiment of FIG. 3 positioned therewithin.

Thermoset polymer guide band 26 has a similar construction to the extent that it also has an internal diameter that exceeds the external diameter of tip 12 so that it can ensleeve said tip during projectile assembly and abuttingly engage metallic band 22 as depicted in FIG. 3. More particularly, the trailing end of thermoset polymer guide band 26 abuts third annular shoulder 24 and the leading end of thermoset polymer guide band 26 abuts first annular shoulder 18 when said thermoset polymer guide band is installed as depicted in said FIG. 3.

Thermoset polymer guide band 26 may be flexible and resilient. Alternatively, it may have alternative properties such as partial rigidity and memory depending on the application desired. The guide band 26 conforms to the shape and size of cylindrical mid-section 16. Its thickness is selected so that it is flush with tip 12 and metallic band 22 as depicted when installed.

Figure 5:
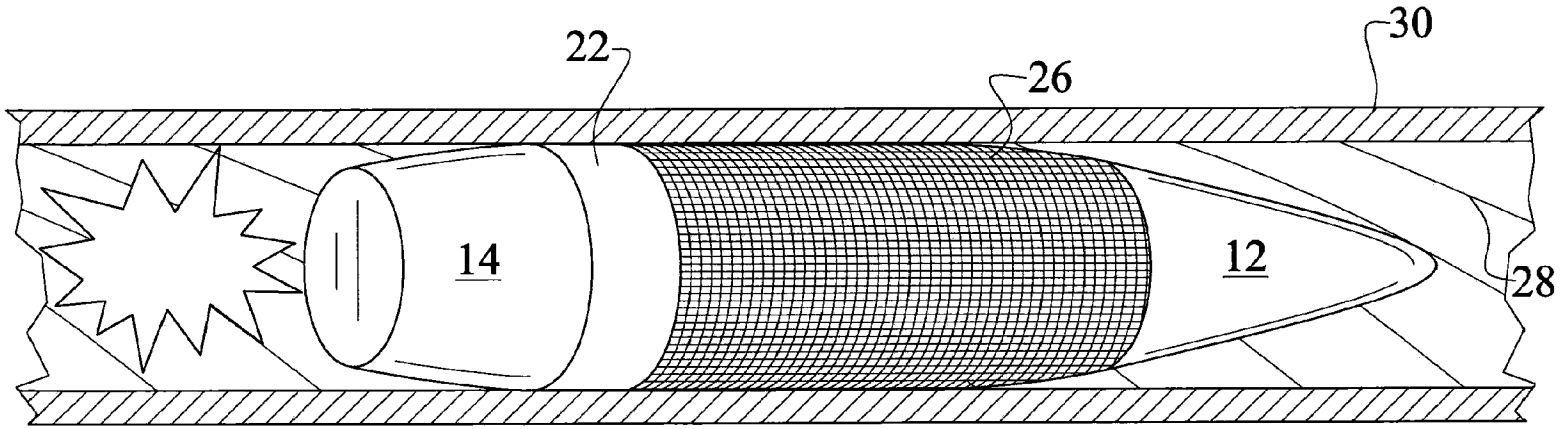
FIG. 5 is a view like that of FIG. 4, depicting said projectile being fired.

Barrel treatment chemicals are impregnated into the polymer so that rifling 28 and barrel 30 are cleaned, lubricated, and otherwise conditioned when projectile 10 is fired as indicated by the starburst in FIG. 5.

Figure 6:
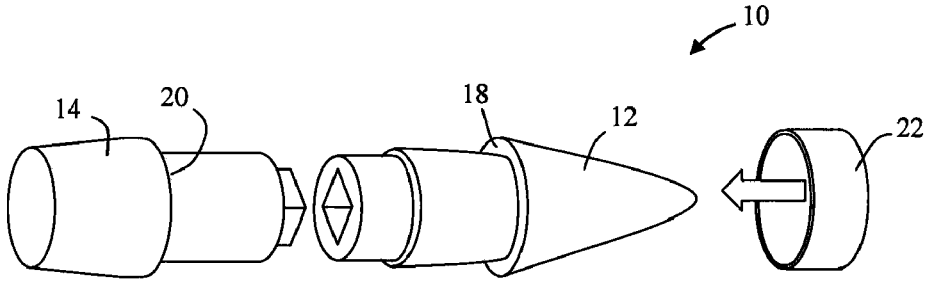
FIG. 6 is an exploded perspective view of an alternate embodiment of the projectile having interlocking head and tail components.
Figure 7:
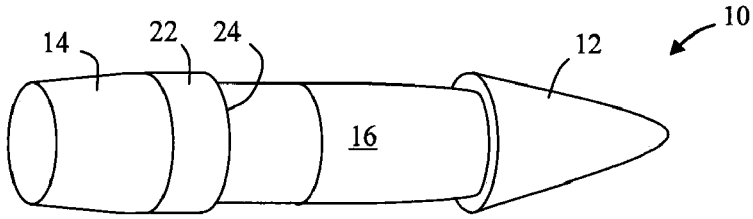
FIG. 7 is an assembled perspective view of an alternate embodiment of the projectile having interlocking head and tail components.
Figure 8:
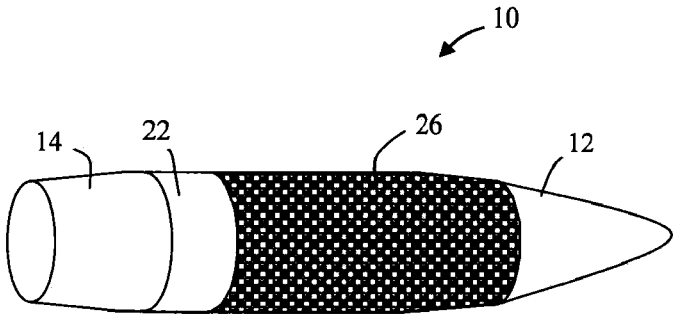
FIG. 8 is an assembled perspective view of an alternate embodiment of the projectile having interlocking head and tail components with the thermoset polymer in place.

FIGS. 6-8 show an alternate embodiment of the invention wherein a multi-component projectile has interlocking head and tail sections to maintain synchronized flight prior to impact whereupon head and tail sections separate.

The polymers used may be color-coded so that the projectile can be used at predetermined intervals to maintain the barrel in good condition. The use of the novel maintenance projectile in accordance with a maintenance schedule substantially reduces downtime and increased projectile velocity by reducing barrel wear, engraving forces, pressure and fouling.

It will thus be seen that the objects set forth above, and those made apparent from the foregoing disclosure, are efficiently attained and since certain changes may be made in the above construction without departing from the scope of the invention, it is intended that all matters contained in the foregoing disclosure or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. A projectile, comprising:

a leading end formed by a tip having an ogive configuration;

a trailing end formed by a frusto-conical base;

a cylindrical mid-section interconnecting said tip and said frusto-conical base to one another;

said cylindrical mid-section having a diameter less than a diameter of said tip at a trailing end of said tip and less than a diameter of said frusto-conical base at a leading end of said frusto-conical base;

a first annular shoulder formed where a trailing end of said tip meets a leading end of said cylindrical mid-section;

a second annular shoulder formed where a trailing end of said cylindrical mid-section meets a leading end of said frusto-conical base;

a metallic band having a trailing end disposed in abutting relation to said second annular shoulder;

a third annular shoulder formed where a leading end of said metallic band meets said cylindrical mid-section;

a flexible and resilient thermoset polymer guide band having a trailing end disposed in abutting relation to said third annular shoulder and a leading end disposed in abutting relation to said first annular shoulder, said flexible and resilient thermoset polymer guide band conforming to the shape and size of said cylindrical mid-section;

said flexible and resilient thermoset polymer guide band having a preselected thickness so that said flexible and resilient thermoset polymer guide band is flush with said tip and said metallic band.

2. The projectile of claim 1, further comprising:

said flexible and resilient thermoset polymer guide band being impregnated with barrel treatment chemicals so that said barrel is cleaned, lubricated, and otherwise conditioned when said projectile is fired.

3. The projectile of claim 1, further comprising:

said metallic band having an internal diameter that exceeds an external diameter of said tip so that said metallic band ensleeves said tip when said projectile is assembled.

4. The projectile of claim 1, further comprising:

interlocked head and tail sections forming a multi-component projectile, the said interlocked head and tail sections separating upon impact.

* * * * *